US005439324A

United States Patent [19]

Ekvall et al.

[11] Patent Number: 5,439,324

[45] Date of Patent: Aug. 8, 1995

[54] BUMPER DOCKING BETWEEN OFFSHORE DRILLING VESSELS AND COMPLIANT PLATFORMS

[75] Inventors: Anders G. C. Ekvall, Houston; David A. Huete, Spring; Lee K. Brasted, Kingwood, all of Tex.

[73] Assignee: Shell Oil Company, Houston, Tex.

[21] Appl. No.: 24,584

[22] Filed: Mar. 1, 1993

[51] Int. Cl.[6] ..... E02B 17/00

[52] U.S. Cl. ..... 405/202; 405/212; 405/223.1

[58] Field of Search ..... 405/195.1, 202, 203, 405/209, 211, 212, 215, 223.1; 114/219, 230, 264, 265

[56] References Cited

U.S. PATENT DOCUMENTS

| | | | |
|---|---|---|---|
| 3,111,692 | 11/1963 | Cox | 405/223.1 X |
| 3,255,627 | 6/1966 | Doig et al. | 73/151 |
| 3,430,601 | 3/1969 | Thompson . | |
| 3,504,740 | 4/1970 | Manning . | |
| 3,645,225 | 2/1972 | Lunde . | |
| 3,717,002 | 2/1973 | O'Brien et al. . | |
| 3,727,414 | 4/1973 | Davies . | |
| 3,798,916 | 3/1974 | Schwemmer | 405/215 |
| 3,890,916 | 6/1975 | Tummers et al. | 114/219 |
| 4,066,030 | 1/1978 | Milone . | |
| 4,156,577 | 5/1979 | McMakin . | |
| 4,185,694 | 1/1980 | Horton | 166/350 |
| 4,492,270 | 1/1985 | Horton . | |
| 4,494,738 | 1/1985 | Britton et al. | 405/212 X |
| 4,497,593 | 2/1985 | Kramer | 405/212 |
| 4,633,953 | 1/1987 | LeBoeuf et al. . | |
| 4,643,614 | 2/1987 | Laursen . | |
| 4,694,771 | 9/1987 | Poldervaart et al. | 114/230 |
| 4,721,412 | 1/1988 | King et al. . | |
| 4,735,526 | 5/1988 | Kawagoe et al. . | |
| 4,740,109 | 4/1988 | Horton . | |
| 4,754,817 | 7/1988 | Goldsmith . | |
| 4,784,529 | 11/1988 | Hunter . | |
| 4,793,737 | 12/1988 | Shotbolt | 405/169 |
| 4,893,965 | 1/1990 | Jordon . | |
| 4,907,657 | 3/1990 | Cox . | |
| 4,907,912 | 3/1990 | Smith . | |
| 4,907,996 | 3/1990 | Poldervaart | 441/3 |
| 4,913,238 | 4/1990 | Danazcko et al. . | |
| 4,934,871 | 6/1990 | Kazokas, Jr. . | |
| 4,966,495 | 10/1990 | Goldman . | |
| 4,972,907 | 11/1990 | Sellars, Jr. . | |
| 4,973,198 | 11/1990 | Cox . | |
| 4,995,762 | 2/1991 | Goldman . | |
| 5,159,891 | 11/1992 | Lohr et al. | 114/230 |
| 5,190,411 | 3/1993 | Huete et al. . | |
| 5,195,848 | 3/1993 | Huete et al. . | |
| 5,199,821 | 4/1993 | Huete et al. . | |
| 5,207,534 | 5/1993 | Brasted et al. . | |

FOREIGN PATENT DOCUMENTS

| | | |
|---|---|---|
| 499859 | 3/1951 | Belgium . |
| WO85/01927 | 5/1985 | WIPO . |

OTHER PUBLICATIONS

"Conoco Readies Jolliet TLWP for Nov. 1 Startup", *Ocean Industry*, pp. 17–21 (Oct. 1989).

H. I. Knecht and M. E. Nagel, "Field Experience Proves Semisubmersible Drilling Tender Concept", *Offshore*, pp. 56–57 (Sep. 1990).

Kerckhoff et al., "Minifloater: A Deepwater Production Alternative", *Ocean Industry*, pp. 147–152 (Sep. 1990).

Chitwood et al., "Semisubmersible Drilling Tender Unit", *SPE Drilling Engineering*, pp. 104–110 (Jun. 1987).

*Primary Examiner*—David H. Corbin

*Attorney, Agent, or Firm*—Mark A. Smith

[57] ABSTRACT

A bumper system is disclosed for docking an auxiliary drilling vessel to a compliant platform through first and second pads having vertically extending, complementary outboard faces presented from the respective structures in vertically slidable abutment. A biasing system pushes the vessel and platform into abutment across the first and second pads and the system allows the vessel to dock to the structure in a manner such that vertical loading is not substantially transmitted between the vessel and the structure across the sliding engagement.

19 Claims, 6 Drawing Sheets

40
42
40A
48
60
10
10A
26
24
30
118
104
12
22
50
50
20
54
52
46
16
28
44
44A
14
44

FIG. 4A
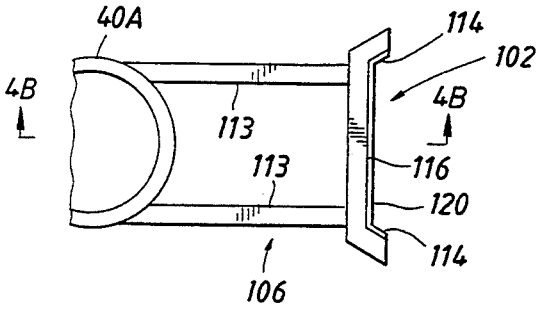
FIG. 5A
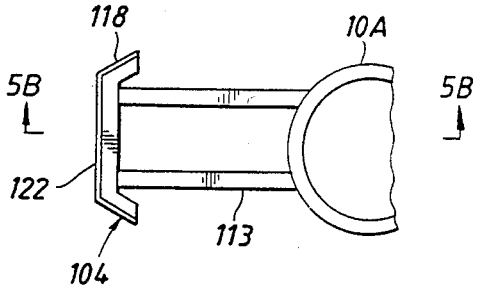
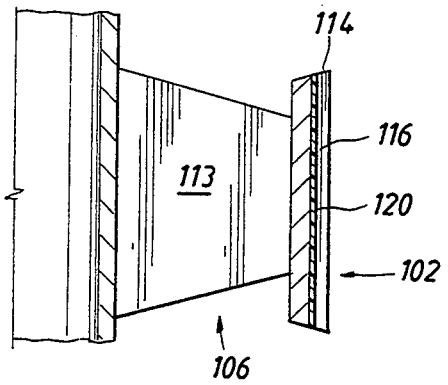
FIG. 4B
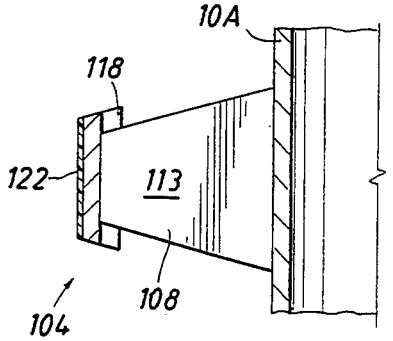
FIG. 5B
FIG. 8
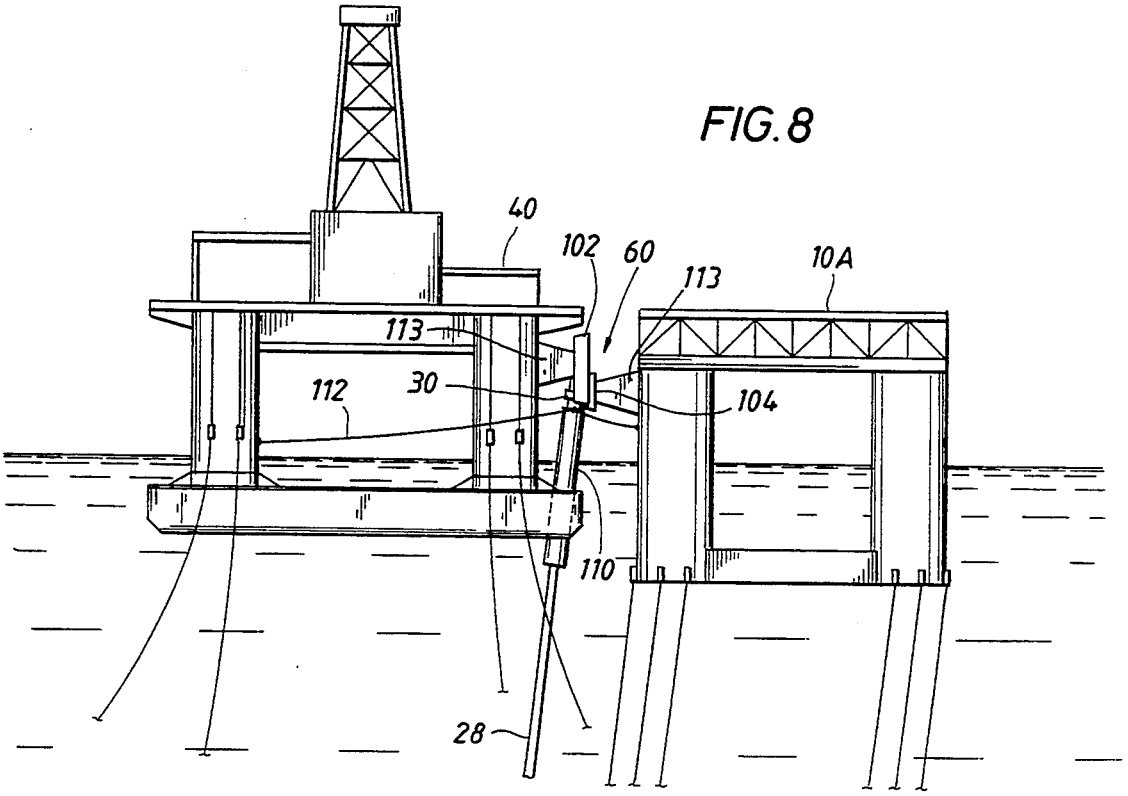

FIG. 9A
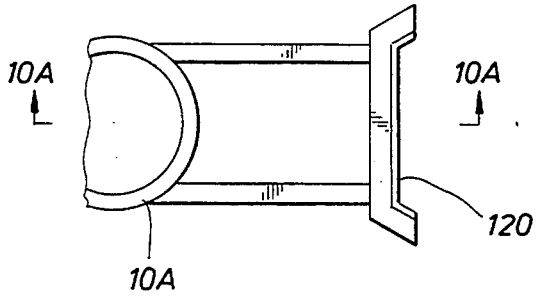
FIG. 9B
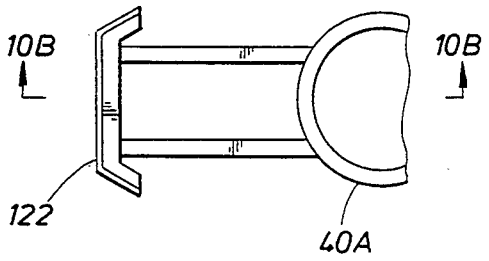
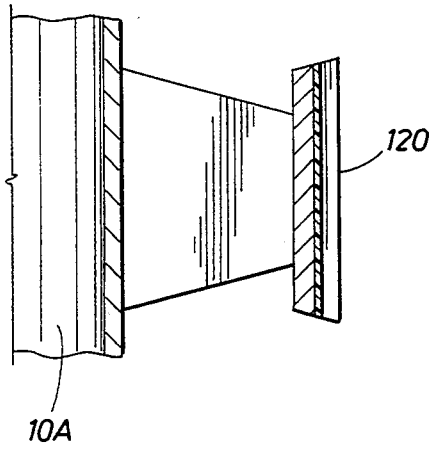
FIG. 10A
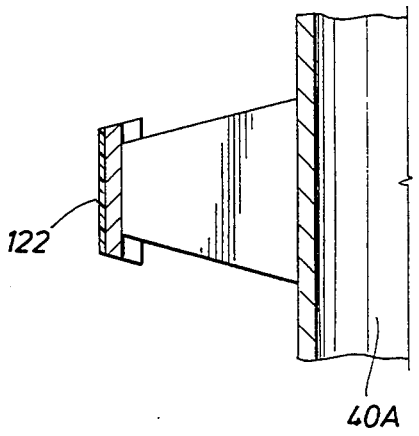
FIG. 10B

BUMPER DOCKING BETWEEN OFFSHORE DRILLING VESSELS AND COMPLIANT PLATFORMS

BACKGROUND OF THE INVENTION

The present invention relates to a method for conducting well operations for offshore reservoirs. More particularly, the present invention relates to a system and method for docking an auxiliary vessel to a compliant platform in support of well operations.

Traditional bottom-founded platforms having fixed or rigid tower structures have been taken to their logical depth limits in the development of offshore oil and gas reserves. Economic considerations suggest that alternatives to this traditional technology be used in deep waters.

Alternative designs have been developed for various configurations of "compliant platforms", e.g., tension leg, compliant tower, and articulated tower platforms as well as floating production systems, which can provide drilling and production facilities in deepwater at costs less than those of traditional fixed platforms.

Further economies and benefits have been provided to the use of such compliant platforms by the recent development of a method for conducting well operations for offshore wells as disclosed copending U.S. patent application Ser. No. 919,630 filed Jul. 24, 1992, which is a continuation of application Ser. No. 624,866 filed Dec. 10, 1990, by D. A. Huete et al, for a Method for Conducting Offshore Well Operations, which application is hereby incorporated by reference and made a part hereof. That application teaches use of an offshore drilling vessel docked to a compliant platform which is driven out of substantially vertical alignment over the well site in order to align a drilling derrick of the offshore drilling vessel thereover. Well operations are then conducted from the drilling vessel and the production riser is transferred from the vessel to the compliant platform. This method facilitates supporting well operations with an auxiliary vessel for surface accessible completions which are then hung on a deepwater compliant platform. This permits the use of a compliant platform which does not have to be scaled to accommodate the weight of a major drilling rig and permits well operation facilities supplied by the auxiliary vessel to relocate when those facilities are not needed at the platform.

However, the auxiliary vessel and the compliant platform respond to environmental loads from wind, wave and current unequally and out of phase. Traditional docking methods will tend to transmit vertical loads from the auxiliary vessel to the compliant platform as the docking elements resist relative motion therebetween. Increasing the capacity of the compliant platform to accommodate such temporary load conditions works against some of the principle benefits of this method of conducting well operations.

Thus there is a need for a restraining or docking system that better facilitates the use of auxiliary vessels in support of well operations for compliant platforms.

A SUMMARY OF THE INVENTION

Toward the fulfillment of this need, the present invention is a bumper system suitable for docking an auxiliary drilling vessel to a compliant platform through first and second pads having vertically extending, complementary outboard faces presented from the respective structures for vertically slidable abutment. A biasing system pushes the vessel and platform into abutment across the first and second pads and the system allows the drilling vessel to dock to the structure in a manner such that vertical loading is not substantially transmitted between the vessel and the structure across the sliding engagement.

BRIEF DESCRIPTION OF THE DRAWINGS

The brief description above, as well as further objects, features and advantages of the present invention will be more fully appreciated by reference to the following detailed description of the preferred embodiments which should be read in conjunction with the accompanying drawings in which:

FIGS. 4A and 5A are top plan views of approaching docking elements in a system in accordance with the present invention.

FIGS. 4B and 5B are cross sectional views of the docking elements taken at lines 4B—4B and 5B—5B in FIGS. 4A and 5A, respectively.

FIG. 8 is a side elevation view of a semisubmersible platform transferring a riser to a compliant platform which is docked thereto in accordance with a practice of the present invention.

FIGS. 9A and 9B are top plan views of approaching docking elements in a system in accordance with the present invention.

FIGS. 10A and 10B are cross sectional views of the docking elements taken at limes 10A–10B in FIGS. 9A and 9B, respectively.

DETAILED DESCRIPTION OF PREFERRED EMBODIMENTS

Figure 1:
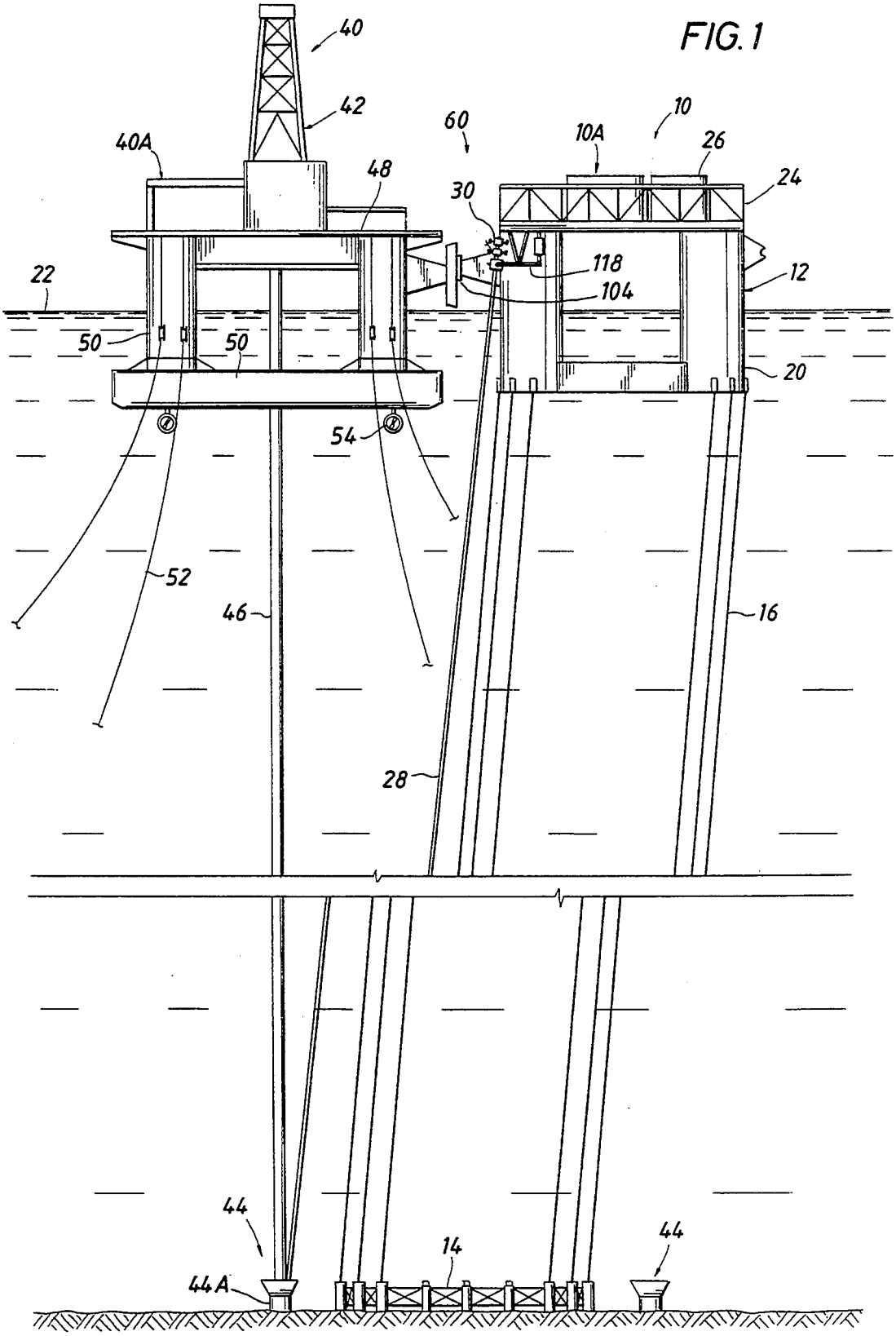
FIG. 1 is a side elevation view of a semisubmersible vessel docked to a tension leg well jacket ("TLWJ") in accordance with the present invention.

FIG. 1 is a side elevation view of a docking system and operations practiced in accordance with the present invention with compliant platform 10 docked to offshore drilling vessel 40, here a semisubmersible vessel 40A.

In this illustration, compliant platform 10 is provided by a tension leg well jacket ("TLWJ") 10A which has a floating superstructure 12 secured to a foundation 14 with a plurality of tendons or tension legs 16 which draw buoyant hull 20 of superstructure 12 below its free-floating draft at ocean surface 22. Hull 20 supports a deck 24 which carries processing facilities 26.

Semisubmersible vessel 40A is illustrated conducting drilling operations with derrick and related drilling facilities 42 supported on deck 48 which is in turn supported by pontoons, columns or other buoyant members 50. The derrick of the semisubmersible vessel is positioned over one of the well sites 44, here at well site 44A, using a catenary mooring system 52 or dynamic positioning thrusters 54 and drilling operations are conducted through a drilling riser 46. A production riser 28 of a previously drilled well is supported by tension leg well jacket 10A with the valve assembly of the surface completion or Christmas tree 30 supported above the ocean's surface in a tensioning system 118.

Offshore drilling vessel 40 interfaces with compliant platform 10 through a docking system 60, here provided by bumper system 111.

Figure 1A:
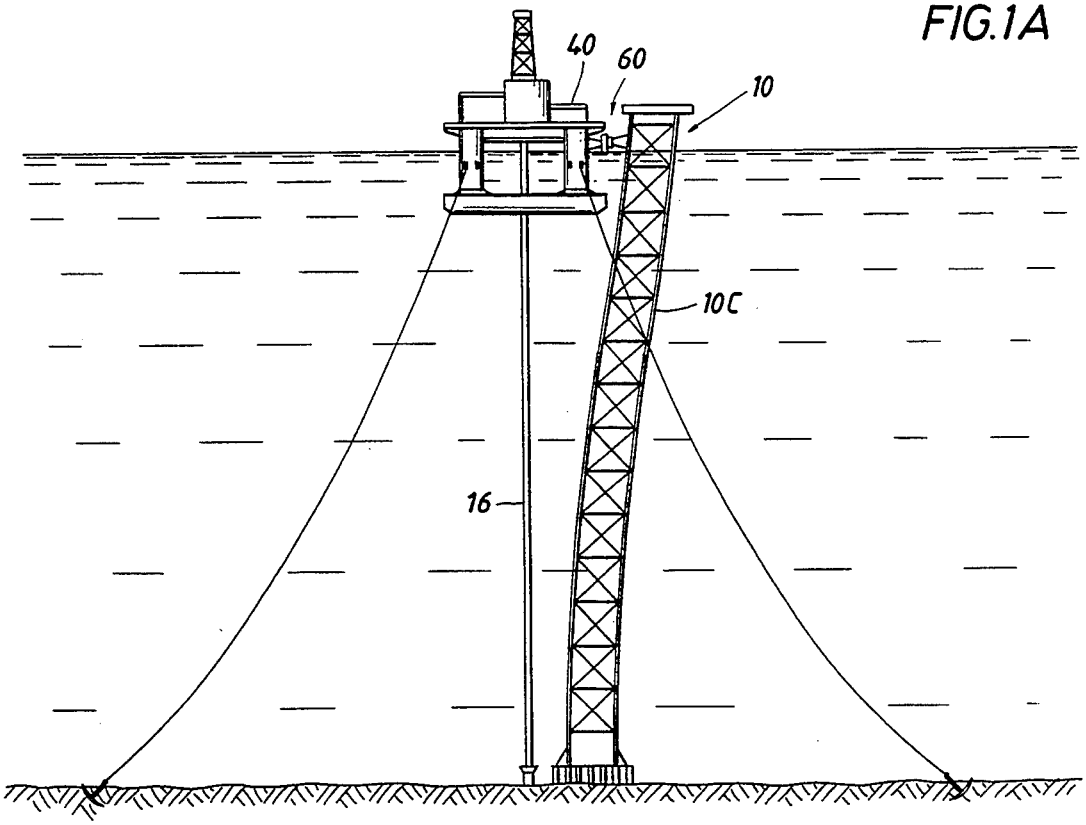
FIG. 1A is a side elevation view of an alternate embodiment of the practice of the present invention in which a semisubmersible vessel is docked to a compliant tower platform.
Figure 1B:
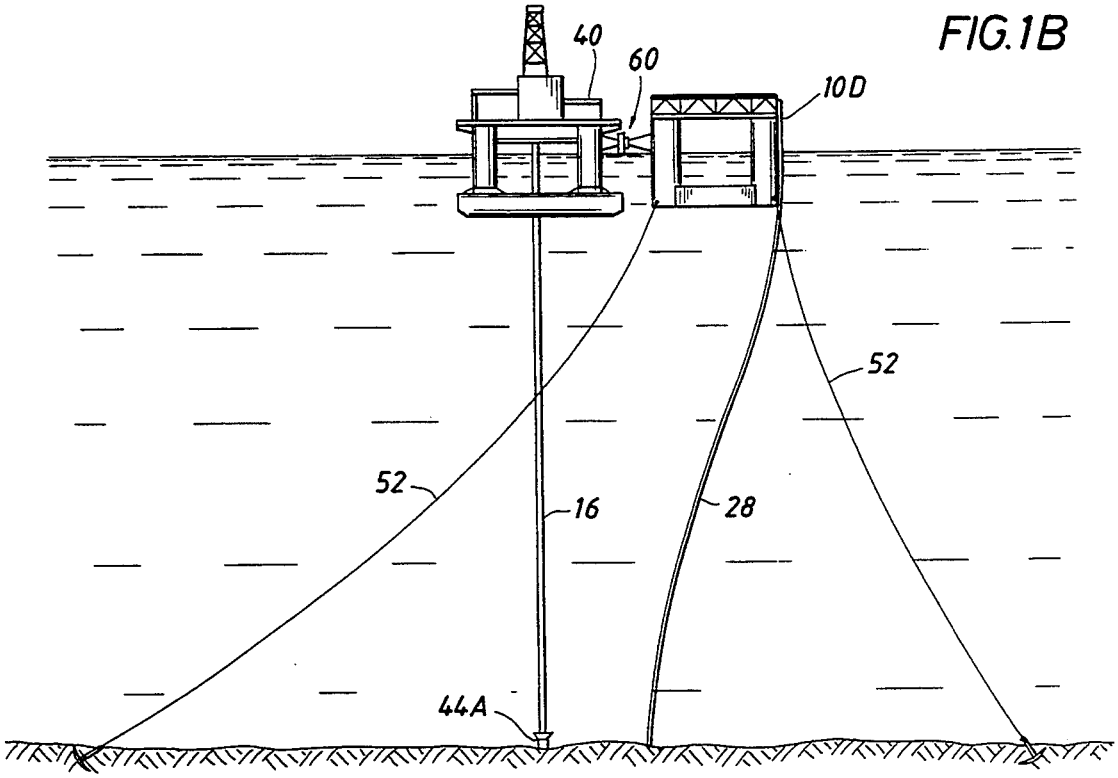
FIG. 1B is a side elevation view of an alternate embodiment of the practice of the present invention in which a semisubmersible vessel is docked to a floating production system ("FPS").

A full range of different compliant platforms can be adapted for use in the practice of the present invention and FIGS. 1A and 1B represent a sample of the breadth of practicing this invention. FIG. 1A is an alternate embodiment of the practice of the present invention in which compliant platform 10 is provided by a compliant tower 10C which is assisted by drilling from offshore drilling vessel 40. FIG. 1B is an alternative embodiment of the practice of the present invention in which an offshore drilling vessel 40 is connected through a bumper docking system 60 to a floating production system 10D which has its own positioning system with catenary mooring lines 52. In this embodiment the floating production system is positioned so that the offshore drilling vessel connected to it will be brought into place over a selected well site 44A for drilling operations.

The present invention facilitates conducting well operations for a compliant platform from an auxiliary vessel. A "compliant" platform is any offshore surface facility designed to "give" in a controlled manner with environmental loading rather than rigidly resist such force. This basic design precept distinguishes the fixed or rigid bottom-founded towers which require vast amounts of structural materials for extension into deep water. Many basic configurations of compliant platforms have been proposed including articulated towers, compliant towers, compliant piled towers, tension leg platforms, etc., a sampling of which are illustrated in the FIG. 1 series discussed above. However, any basic configuration which is compliant, favorably economically sensitive to load reductions, and adapted to receive laterally transferred production risers is well suited for use in the practice of the present invention. FIGS. 2 through 8 illustrate the practice of the present invention in support of a tension leg well jacket which is a minimal tension leg platform without drilling capabilities, and, at most, modest workover capabilities. However, those skilled in the art and familiar with the teachings of this application could apply this practice to any other basic compliant platform configuration.

Figure 2:
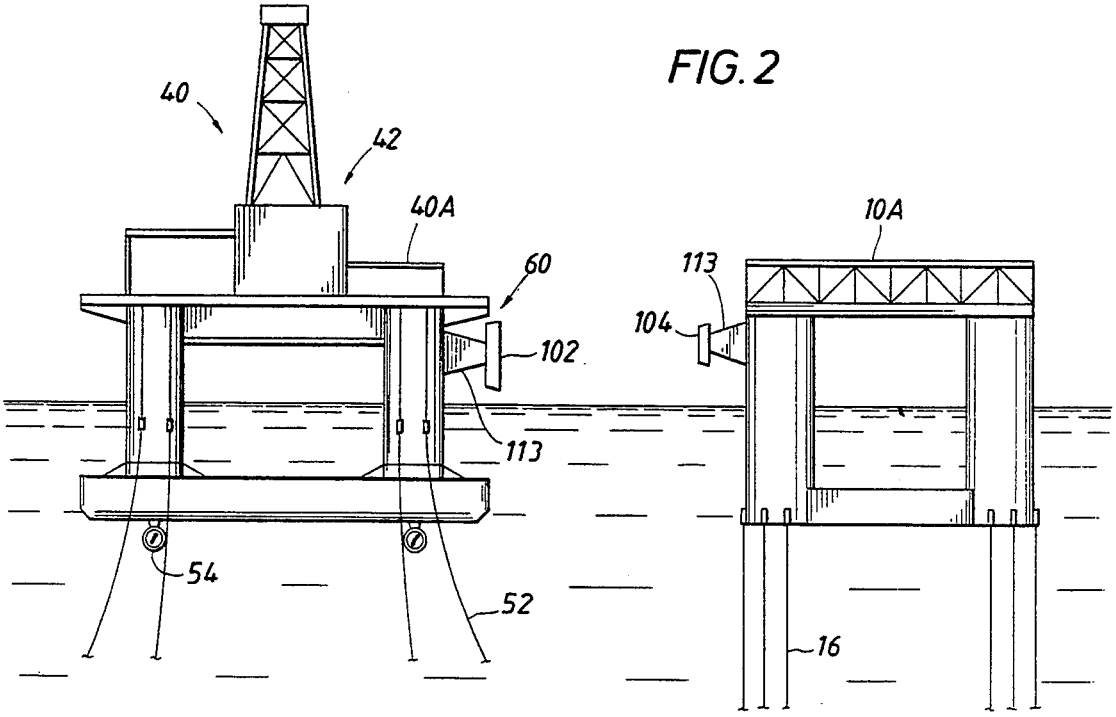
FIG. 2 is a side elevation view of a docking approach for a semisubmersible vessel and a compliant platform which are about to dock in accordance with the present invention.
Figure 3:
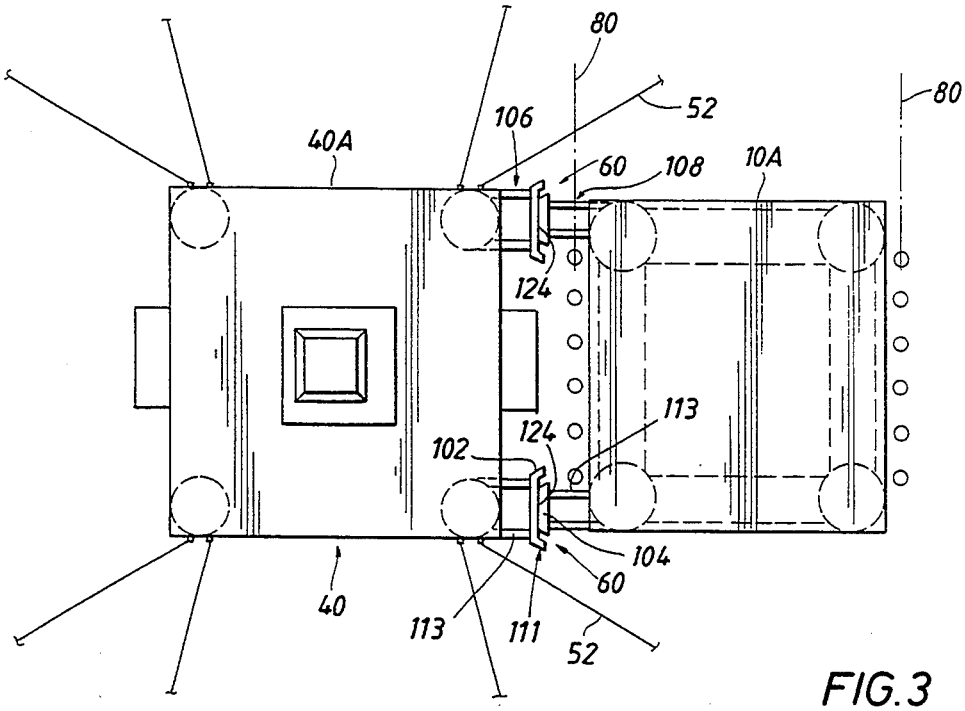
FIG. 3 is a top plan view of a semisubmersible vessel and a compliant platform completing docking operations in accordance with the practice of an embodiment of the present invention.

FIG. 2 illustrates deployment of offshore drilling vessel 40 adjacent installed tension leg well jacket 10A. The offshore drilling vessel is a floating structure which carries a derrick, drawworks and related drilling facilities 42. Further, the term "offshore drilling vessel" is intended to cover any transportable, floating facilities of an auxiliary vessel capable of supporting well operations such as drilling, completion, workover, well repair or abandonment. Preferably, these facilities are provided in a substantially open design adapted for stability in deepwater drilling applications. Semisubmersible vessels represent a class of vessels well suited to this application and have been used throughout to generally illustrate the practice of the present invention.

Semisubmersible vessel 40A in FIG. 2 is maneuverable by either catenary mooring lines 52 or dynamic positioning thrusters 54. For purposes of this embodiment of the practice, the catenary mooring lines are deployed and anchored in a spread about the semisubmersible vessel which overlaps the position of the tension leg well jacket. Semisubmersible vessel 40A can then be maneuvered with respect to tension leg well jacket 10A by playing out and retrieving selected catenary mooring lines 52.

The docking system 60 of the converging semisubmersible vessel 40A and tension leg well jacket 10A are illustrated in greater detail in FIGS. 4A, 4B, 5A and 5B. In this embodiment, a first pad 102 having outwardly extending shoulders 114 defines a concave surface or facing 120 together with trough 116. See FIGS. 4A and 4B. The first pad is mounted to semisubmersible vessel 40A through first mount 106 having extension arms 113.

Referring to FIGS. 5A and 5B, a corresponding convex surface or complementary facing 122 is defined by second pad 104 having inboardly extending shoulders 118. Second pad 104 is mounted to tension leg well jacket platform 10A through a second mount 108 projected outwardly from the tension leg well jacket on extension arms 113. As offshore drilling vessel 40 and tension leg well jacket 10A converge, first pad 102 receives second pad 104 at interface 124. See FIG. 3.

In the preferred embodiment, facing 120 and complementary facing 122 are covered with a durable, low friction finish, e.g., ultra high molecular weight polyethylene, so that the interface 124 substantially decouples the vertical loading between the offshore drilling vessel and the compliant platform created by uneven sequential response to environmental forces such as waves and current. Further, in platform designs having a direct vertical link to the sea floor in normal position, the operations biasing the complaint platform to the side and returning it to normal will cause some vertical relative motion therebetween as the compliant platform will tend to be displaced in an arc about the sea floor. See FIGS. 1, 1A, and 8.

It should be understood that the relative mounting of the first and second pads with shoulders to present concave and convex faces, respectively, can be reversed. See corresponding FIGS. 9A, 9B, 10A and 10B, in which concave surface or facing 120 is mounted to the compliant platform and corresponding convex or complementary facing 122 is presented on semisubmersible vessel 40A. Further, the shoulders and even the mounts may be omitted provided that structurally sound surfaces, i.e. first and second pads, are present in a manner presenting vertically extending outboard faces 120 and 122 configured to allow relative vertical motion therebetween when the offshore drilling vessel and the compliant platform are docked together for well operations.

Figure 6:
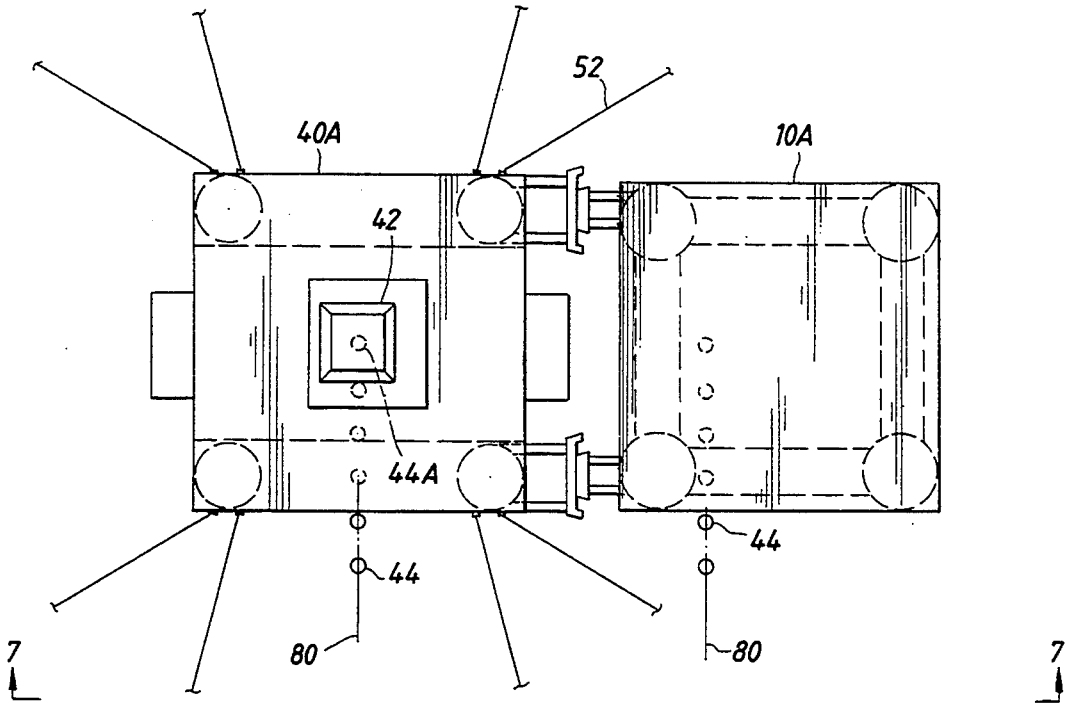
FIG. 6 is a top plan view of a semisubmersible vessel docked to a compliant platform in accordance with the practice of an embodiment of the present invention and taking position for drilling operations over a selected well site.
Figure 7:
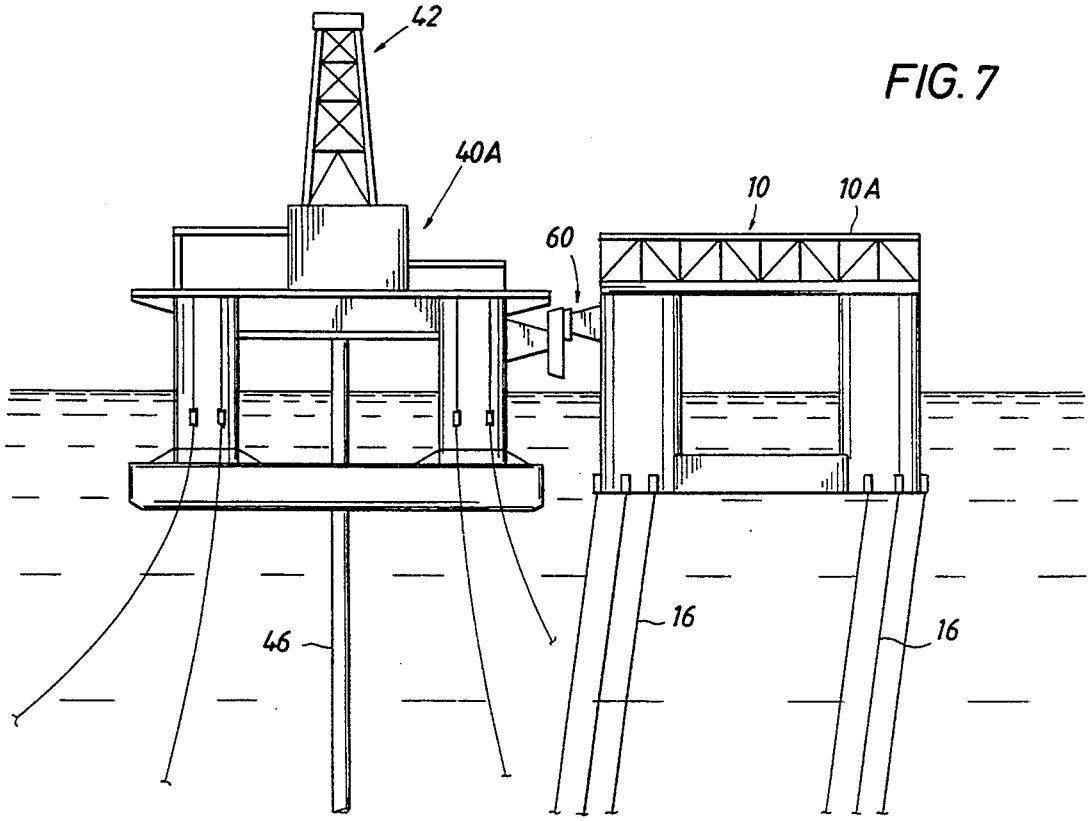
FIG. 7 is a side elevation view of a semisubmersible vessel docked with a compliant platform in accordance with the practice of an embodiment of the present invention and conducting drilling operations.

Docking facilitates moving tension leg well jacket 10A with positioning systems carried on semisubmersible vessel 40A. Compare FIG. 3 in which tension leg well jacket 10A is normally centered between well lines 80 at the periphery of the tension leg well jacket with FIG. 6 wherein the catenary mooring lines 52 have been adjusted to bias tension leg well jacket 10A out of alignment with its nominal position and to bring the derrick and related drilling facilities 42 into alignment with a selected well site 44A. The semisubmersible vessel of FIG. 6 is in position to initiate drilling or other well operations through a drilling riser 46 as further illustrated in FIG. 7. The drilling operations are best undertaken in substantially vertical drilling risers and the ability to shift compliant platform 10 slightly out of alignment with its nominal resting position in order to place the derrick over a selected well site substantially enhances drilling efficiency and reduces equipment wear. This ability also allows continuing drilling operations once the tension leg well jacket is in place and thereby allows production to come onstream as soon as wells are completed, even as the drilling program proceeds.

After drilling or other well operations are performed, drilling riser 46 may be replaced with a lighter weight production riser 28 and the drilling facilities on offshore drilling vessel 40 may be used through the production riser to complete the well. After completion of the well and installation of a surface christmas tree 30, a temporary buoyancy module 110 is installed about the production riser and the production riser is passed or transferred to compliant platform 10, here tension leg well jacket 10A. See FIG. 8. Alternatively, a temporary, small workover riser may be installed on tension leg well jacket 10A and used to install the production riser and complete the well.

Guylines 112 are used to draw production riser 28 to tension leg well jacket 10A. Alternatively, the natural righting ability of temporary buoyancy module 110 is used to maintain production riser 28 in place while catenary mooring lines 52 are adjusted to bring tension leg well jacket 10A into position to receive the substantially stationary production riser 28. The presently preferred method for undertaking this transfer is a combination of both the methods.

Further details of the general use and benefits of the method of conducting well operations facilitated by the present invention are discussed in U.S. patent application Ser. No. 919,630, referenced above.

A number of variations have been disclosed for docking systems and techniques for joining offshore vessel and structures in a manner which isolates each from the transmission of vertical loads from the other. As noted above, this docking system and technique are uniquely suited to, but in its broadest elements not limited to, providing temporary facilities of an offshore vessel to a tension leg well jacket for conducting well operations. Other modifications, changes and substitutions are intended in the foregoing disclosure. Further, in some instances, some features of the present invention will be employed without a corresponding use of other features described in these preferred embodiments. Accordingly, it is appropriate that the appended claims be construed broadly and in a manner consistent with the spirit and scope of the invention herein.

What is claimed is:

1. A bumper system for docking an auxiliary vessel with a compliant platform comprising:

a first pad presenting a vertically extending outboard face from the auxiliary vessel;

a second pad presenting a vertically extending complementary outboard face from the compliant platform configured to engage the outboard face of the first pad in vertically slidable abutment; and a biasing system to push the auxiliary vessel and the compliant platform into abutment across the first and second pads;

whereby the auxiliary vessel docks to the compliant platform in a manner such that vertical loading is not substantially transmitted between the vessel and the compliant platform across the sliding engagement of the abutted first and second pads.

2. A bumper system in accordance with claim 1, further comprising a low friction, wear resistant facing on both the first and second pads.

3. A bumper system in accordance with claim 2, further comprising:

a plurality of first pads mounted on the auxiliary vessel, each presenting its outboard face in a vertically extending orientation; and a plurality of second pads mounted on the compliant platform, each presenting its outboard face in a vertically extending orientation.

4. A bumper system in accordance with claim 1, further comprising a first mount having an extension arm presenting the first pad outboard of the auxiliary vessel.

5. A bumper system in accordance with claim 4, further comprising a second mount having an extension arm presenting the second pad outboard of the compliant platform.

6. A bumper system in accordance with claim 1, further comprising a mount having an extension arm presenting the second pad outboard of the compliant platform.

7. A bumper system for docking an offshore drilling vessel with a compliant platform, comprising:

a first pad presenting a vertically extending outboard face;

a first mount connecting the first pad to the offshore drilling vessel;

a second pad presenting a vertically extending complementary outboard face configured to engage the outboard face of the first pad in vertically slidable abutment;

a second mount connecting the second pad to the compliant platform;

a biasing system to push the offshore drilling vessel and the compliant platform into abutment across the first and second pads;

whereby the offshore drilling vessel docks to the compliant platform in a manner such that vertical loading is not substantially transmitted between the vessel and the compliant platform across the sliding engagement of the abutted first and second pads.

8. A bumper system in accordance with claim 7 wherein the compliant platform is a TLP.

9. A bumper system in accordance with claim 8 wherein the TLP is a tension leg well jacket.

10. A bumper system in accordance with claim 7 wherein the compliant platform is a compliant tower.

11. A bumper system in accordance with claim 7 wherein the compliant platform is a floating production system.

12. A bumper system in accordance with claim 7, further comprising a low friction, wear resistant facing on both the first and second pads.

13. A bumper system in accordance with claim 7, further comprising:

a plurality of first pads mounted on the offshore drilling vessel; and a plurality of second pads mounted on the compliant platform.

14. A bumper system in accordance with claim 7, wherein the first mount further comprises an extension arm presenting the first pad outboard of the offshore drilling vessel.

15. A bumper system in accordance with claim 14, wherein the second mount further comprises an extension arm presenting the second pad outboard of the compliant platform.

16. A bumper system in accordance with claim 7, wherein the second mount further comprises an extension arm presenting the second pad outboard of the compliant platform.

17. A bumper system in accordance with claim 7, further comprising vertically extending outboardly angled shoulders on the lateral edges of the first pad to define a vertically extending trough which receives the second pad.

18. A bumper system in accordance with claim 7, further comprising vertically extending angled shoulders on the lateral edges of the second pad to define a vertically extending trough which receives the first pad.

19. A method for conducting offshore well operations, comprising:

restraining an offshore drilling vessel with respect to a compliant platform through a bumper system, comprising:

presenting from the offshore drilling vessel a vertically extending outboard face of a first pad;

presenting from the compliant platform a vertically extending complementary outboard face of a second pad configured to engage the outboard face of the first pad in vertically slidable abutment;

biasing the offshore drilling vessel and the compliant platform into abutment across the first and second pads;

positioning the offshore drilling vessel over a selected well site comprising:

driving the compliant platform out of substantially vertical alignment with the selected well site; and substantially vertically aligning a drilling derrick of the offshore drilling vessel over the selected well site and securing this position for well operations while continuing to restrain the position of the offshore drilling vessel with respect to the compliant platform; and conducting well operations from the offshore drilling vessel through a substantially vertical riser.

* * * * *